US008845082B2

(12) United States Patent
Bacon et al.

(10) Patent No.: US 8,845,082 B2
(45) Date of Patent: Sep. 30, 2014

(54) INLET MANIFOLD FOR AN INKJET PRINTHEAD

(75) Inventors: Robin Timothy Bacon, Cambridge (GB); Ian Butler Philip Ingham, Saffron Walden (GB)

(73) Assignee: Tonejet Limited, Melbourn, Royston, Herfordshire (GB)

( * ) Notice: Subject to any disclaimer, the term of this patent is extended or adjusted under 35 U.S.C. 154(b) by 0 days.

(21) Appl. No.: 13/997,949

(22) PCT Filed: Dec. 20, 2011

(86) PCT No.: PCT/EP2011/073314

§ 371 (c)(1), (2), (4) Date: Jun. 25, 2013

(87) PCT Pub. No.: WO2012/089549

PCT Pub. Date: Jul. 5, 2012

(65) Prior Publication Data

US 2013/0293637 A1 Nov. 7, 2013

(30) Foreign Application Priority Data

Dec. 30, 2010 (EP) ..... 10197339

(51) Int. Cl.

| | |
|---|---|
| ***B41J 2/175*** | (2006.01) |
| ***B41J 2/04*** | (2006.01) |
| ***B41J 2/06*** | (2006.01) |
| *B41J 2/14* | (2006.01) |

(52) U.S. Cl.

CPC ..... *B41J 2/175* (2013.01); *B41J 2002/14419* (2013.01); *B41J 2/06* (2013.01); *B41J 2202/12* (2013.01)

USPC ..... 347/85; 347/54

(58) Field of Classification Search

None

See application file for complete search history.

(56) References Cited

U.S. PATENT DOCUMENTS

| | | | |
|---|---|---|---|
| 2003/0025766 | A1 | 2/2003 | Tanaka et al. |
| 2010/0238238 | A1 | 9/2010 | Yamamoto |

FOREIGN PATENT DOCUMENTS

| | | | | |
|---|---|---|---|---|
| EP | 0594110 | A2 | 4/1994 | |
| EP | 1366901 | A1 | 12/2003 | |
| EP | 1884294 | A1 | 2/2008 | |
| WO | WO 2009/142889 | A1 * | 11/2009 | ..... B41J 2/18 |

* cited by examiner

*Primary Examiner* — Geoffrey Mruk

(74) *Attorney, Agent, or Firm* — Roylance, Abrams, Berdo & Goodman, LLP

(57) ABSTRACT

An ink manifold for an inkjet printhead is provided, comprising a number of substantially parallel transverse channels 709,713 connected by one or more connecting passages 719. The resistance to flow provided by the connecting passages is substantially greater than the resistance to flow along the length of a transverse channel. The ink manifold provided by the present invention ensures that the ink pressure and flow rate presented to the ejectors of the printhead is uniform along the entire length of the ejector array and, moreover, does so in a shallower manifold design than has previously been known.

14 Claims, 7 Drawing Sheets

INLET MANIFOLD FOR AN INKJET PRINTHEAD

FIELD OF THE INVENTION

The present invention relates to an ink manifold structure for use in a printhead.

BACKGROUND

The general method of operation of the type of printhead described in WO 93/11866 is well known, wherein an agglomeration or concentration of particles is achieved in the printhead, and, at the ejection location, the agglomeration of particles is then ejected on to a substrate. In the case of an array printer, plural cells may be arranged in one or more rows.

WO 03/101741 describes a particular arrangement of printhead which comprises an ejector array mounted within a main body, to which an intermediate electrode plate is mounted. Ink is ejected from the ejector array by the action of an electric field generated between electrodes situated within the ejector array and the intermediate electrode as is well understood by the person skilled in the art. Typically, the ejector array is formed as a laminate structure which includes at least an ink inlet manifold, an ink inlet prism, a central tile and an ink outlet manifold. The central tile has the array of ejection points formed along its front edge and both the central tile and the prism include channels for supplying ink to the ejector array. Specifically, in the printhead described in WO 03/101741, a particular shape of ink manifold is chosen which provides desirable ink flow characteristics to and from the ejection locations of the ejection array.

The shape of the inlet manifold of the printhead described in WO 03/101741 comprises a triangular chamber which is divergent in a direction from the inlet of the ink supply (i.e. the position within the manifold at which ink is input from a supply line) to the outlet (the outlet position being a front surface of the manifold along which ink is supplied to the array of ejection locations). The outlet manifold has a similar shape, but which is convergent in a direction from its inlet (which is the surface of the outlet manifold along which surplus ink is returned from the array of ejection locations) to its outlet (i.e. the position within the outlet manifold at which ink is output to a return line).

Whilst providing desirable ink flow characteristics to the array of ejection locations, the shape of the ink manifold described in WO 03/101741 results in inlet/outlet manifolds which have a relatively large width dimension from front to back (i.e. from the ink supply inlet into the inlet manifold to the front surface which connects to the array of the ejection locations or, for the outlet manifold, from the surface which connects to the array of the ejection locations to the ink output position). This necessarily results in a printhead which also has a relatively large width dimension from front to back.

An object of the present invention is to provide a printhead having a significantly reduced width from front to back (i.e. the distance from the array of ejection locations to the rear of the printhead block), but which also retains and improves upon the desirable ink flow characteristics of the printhead described in WO 03/101741.

SUMMARY OF THE INVENTION

In accordance with a first aspect of the present invention, an ink manifold for an inkjet printhead is provided which may comprise a substantially planar body which is longer in a length direction than a width direction and which has formed in a surface thereof: a first transverse channel for direct connection to ejection locations of said printhead along the length of the first channel, said first channel extending substantially parallel to the length direction of the body; and an adjacent transverse channel extending substantially parallel to the length direction of the body, said adjacent transverse channel being in fluid communication with a supply or sink of ink, and arranged to receive ink from the supply or pass ink to the sink, wherein the adjacent transverse channel is not directly connected to the ejection locations; wherein two or more connecting passages are arranged between adjacent ones of said transverse channels, operable to allow ink to flow between the transverse channels; wherein each connecting passage is sized such that it provides a greater flow restriction to ink flowing between the transverse channels than the restriction to flow of ink along the length of each transverse channel so that the pressure distribution of ink within said first transverse channel is substantially uniform along the length of said channel.

Preferably, said ink manifold may further comprise at least one further transverse channel, extending substantially parallel to the length direction of the body, and being connected between said adjacent transverse channel and said ink supply or sink via two or more additional connecting passages, wherein the adjacent transverse channel is in fluid communication with the supply or sink of ink via said at least one further transverse channel. One or more of the connecting passages connecting one pair of said transverse channels may be offset with respect to one or more of the connecting passages connecting an adjacent pair of channels.

Preferably, each channel may have a depth of 1 to 2 millimeters as measured from the surface of said body in which they are formed. Preferably, each channel may also have a width substantially between 2 to 4 millimeters and a length substantially between 100 and 110 millimeters.

Preferably, each of the two or more connecting passages may have a depth of 0.5 millimeters as measured from the surface of said body into which it is formed. Preferably, the two or more connecting passage may also have a length, as measured substantially parallel to the length of said channels, of between 2 to 10 millimeters and may have a width, said width being the distance between the adjacent channels which said passage connects, of 1 to 3 millimeters.

Preferably, the body has a thickness (measured from a top surface to a bottom surface of the body) of between approximately 9 mm to 11 mm, a width dimension (measured from the side of the body for connection to said ejection locations to the rear of the body opposite the ejection locations) of approximately 30 mm, and a length dimension (measured along the side of the body along which the ejection locations are arrayed) of approximately 110 mm to 170 mm.

Preferably, the ink manifold of the present invention allows ink to flow from said adjacent transverse channel to ejection locations via the first transverse channel. Alternatively, the ink manifold of the present invention allows ink to flow from the ejection locations to said adjacent transverse channel via said first transverse channel. In accordance with a further aspect of the present invention, an electrostatic printhead may be provided comprising: a housing having an inlet for the supply of ink; an array of ejection locations for the ejection of ink droplets; and an ink supply pathway for the passage of ink from the inlet to the ejection locations, wherein the ink supply pathway may comprise the ink manifold of the first aspect of the present invention, said adjacent transverse channel being operable to receive ink from said inlet for the supply of ink.

In accordance with a further aspect of the present invention, an electrostatic printhead may be provided comprising: a housing having an outlet for the removal of ink; an array of ejection locations for the ejection of ink droplets; and an ink removal pathway for the passage of ink from the ejection locations to the ink outlet, wherein the ink removal pathway may comprise the ink manifold according to the first aspect of the present invention, said adjacent transverse channel being operable to receive ink from said first transverse channel and supply ink to said outlet.

In accordance with a further aspect of the present invention, an electrostatic printhead may be provided comprising: a housing having an inlet and an outlet for the supply and removal, respectively, of ink; an array of ejection locations for the ejection of ink droplets; an ink supply pathway for the passage of ink from the inlet to the ejection locations; and an ink removal pathway for the passage of ink from the ejection locations to the ink outlet, wherein the ink supply pathway may comprise the ink manifold according to any one of claims 1 to 10, said adjacent transverse channel being operable to receive ink from said inlet for the supply of ink, and wherein the ink removal pathway may comprise the ink manifold according to any one of claims 1 to 9 and 11, said adjacent transverse channel being operable to receive ink from said first transverse channel and supply ink to said outlet.

Preferably, the electrostatic printhead has a thickness of approximately 20 mm measured from a top surface to a bottom surface of the printhead, a width dimension of approximately 46 mm as measured from the ejection locations (317) to the rear of the printhead opposite the ejection locations (317), and a length dimension of approximately 148 mm as measured along the side of the printhead along which the ejection locations (317) are arrayed.

In accordance with a further aspect of the present invention, a method for use with an inkjet printhead may be provided comprising either: supplying ink to an ink manifold according to the first aspect of the present invention, said adjacent transverse channel being operable to receive ink from said inlet for the supply of ink; or receiving ink from an ink manifold according to the first aspect of the present invention where said adjacent transverse channel is operable to receive ink from said first transverse channel and supply ink to said outlet.

The invention defined above advantageously provides an ink manifold which provides good ink flow characteristics to or from the ejection locations of a printhead, in terms of pressure distribution and flow rate, whilst reducing the distance from the front to the back of the ink manifold, i.e. the width of the ink manifold from the front (location of the ejection locations) to back (rear of the manifold opposite the ejection locations), thereby resulting in an ink manifold which is significantly smaller from front to back than conventional ink manifolds and which consequently, when incorporated into an electrostatic printhead, results in an electrostatic printhead which is significantly smaller from front to back (i.e. from the ink ejection portion of the printhead to the rear side of the printhead opposite the ejection locations) than conventional electrostatic printheads.

DESCRIPTION OF THE DRAWINGS

Various embodiments of the invention will now be described with reference to the attached figures in which.

DESCRIPTION OF THE PREFERRED EMBODIMENT

Figure 1:
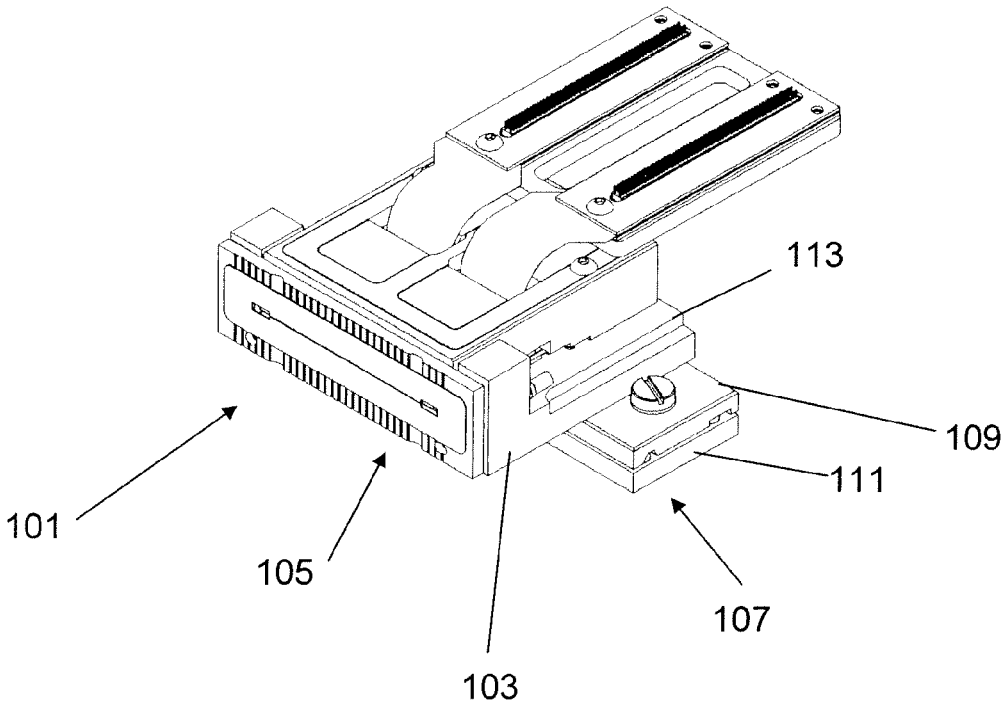
Figure 1 (PRIOR ART)
FIG. 1 is a perspective view of a typical prior art printhead.

The printhead shown in FIG. 1 corresponds to a typical prior art printhead as described in WO 03/101741. The printhead 101 comprises a main body 103 to which the remaining components are connected. Within the main body 103 is mounted an ejection portion consisting of a laminated structure that includes ink inlet and outlet manifolds and an ejector array. On one end of the main body 103, an intermediate electrode plate 105 is mounted by means of a kinematic mount.

Figure 2:
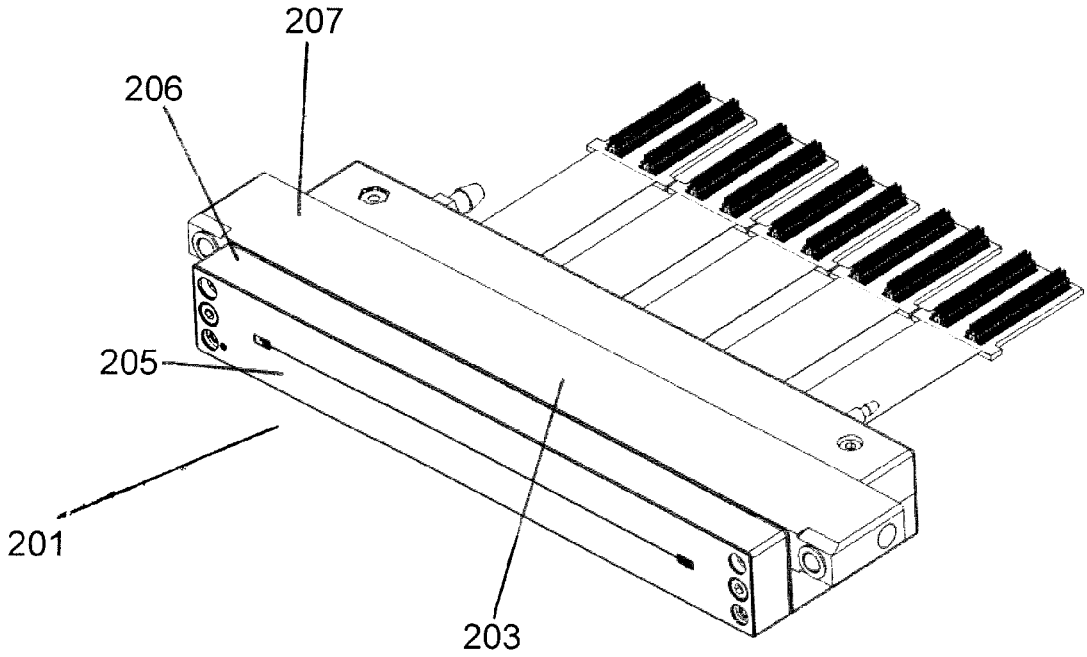
FIG. 2 is a perspective view of a printhead according to the present invention.
Figure 3:
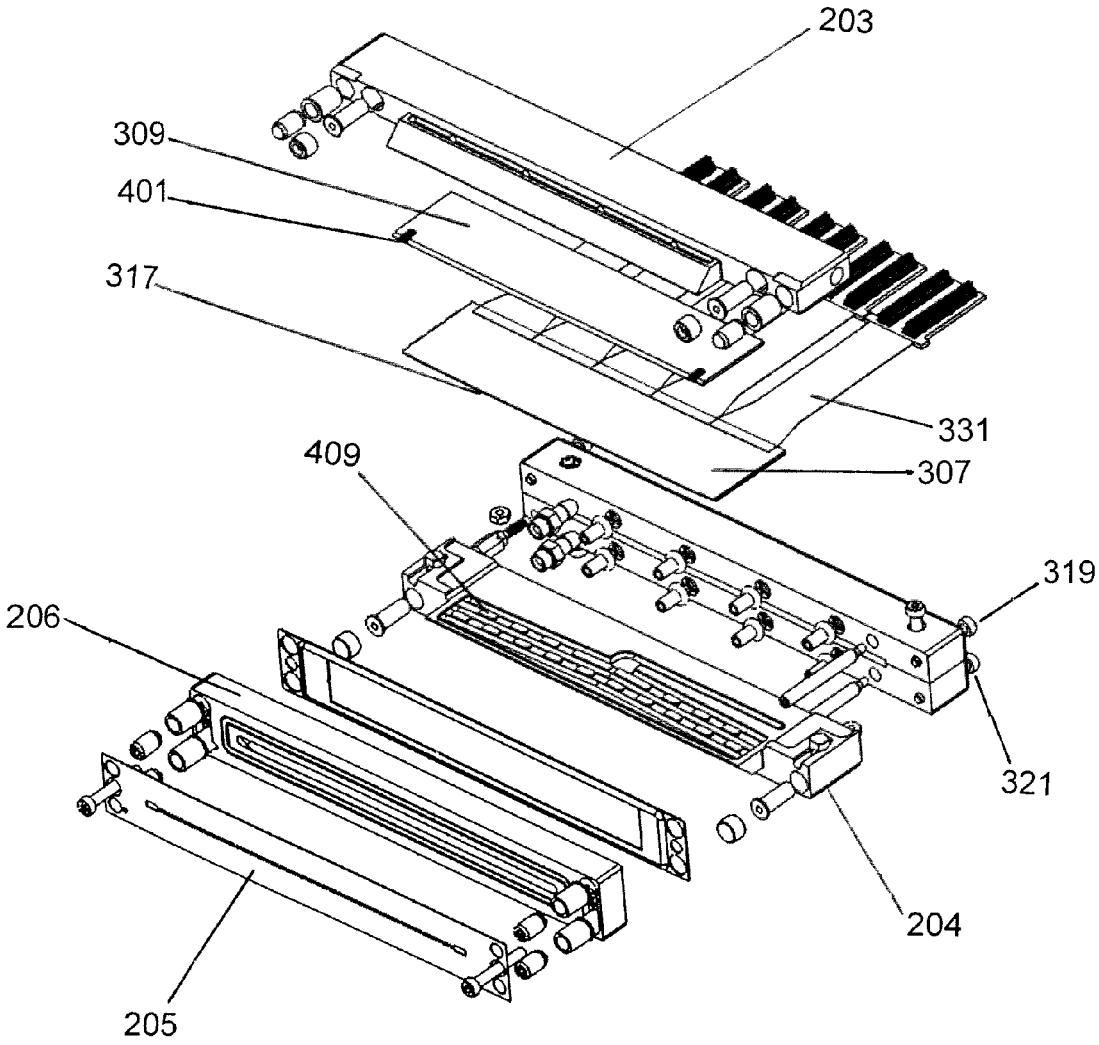
FIG. 3 is an exploded view of the printhead illustrated in FIG. 2.

FIGS. 2 and 3 illustrate a printhead in accordance with the present invention. Although the printhead of the present invention shares a number of similarities with the prior art printhead described in WO 03/101741, the shape of the printhead of the present invention is substantially different. When compared to the printhead described in WO 03/101741, the body of the printhead of the present invention is narrower from the front of the body where the ejection locations are provided to the rear of the body opposite the ejection locations by a factor of approximately 1.4 whilst the length of the array of ejectors is approximately 2.5 times longer than in a conventional body. Specifically, the body of the printhead described in WO 03/101741 measures 64 mm in width from the front where the ejection locations are provided to the back of the body opposite the ejection locations, it has a thickness of 25 mm from top to bottom (i.e. the thickness measured perpendicular to the line of ejectors and perpendicular to the width dimension) and a length of 75 mm as measured along the side of the body along which the ejection locations are arrayed whereas, in a preferred embodiment, the equivalent dimensions of the printhead of the present invention are 46 mm, 20 mm and 148 mm.

The printhead 201 of the present invention comprises a two-part main body consisting of an inflow block 203 and an outflow block 204, between which are located a prism (309) and a central tile (307), the latter having the ejector array formed along its front edge. At the front of the printhead, an intermediate electrode plate 205 is mounted on to a datum plate 206, which in turn is mounted onto the main body of the printhead by means of a kinematic mount.

Figure 4A:
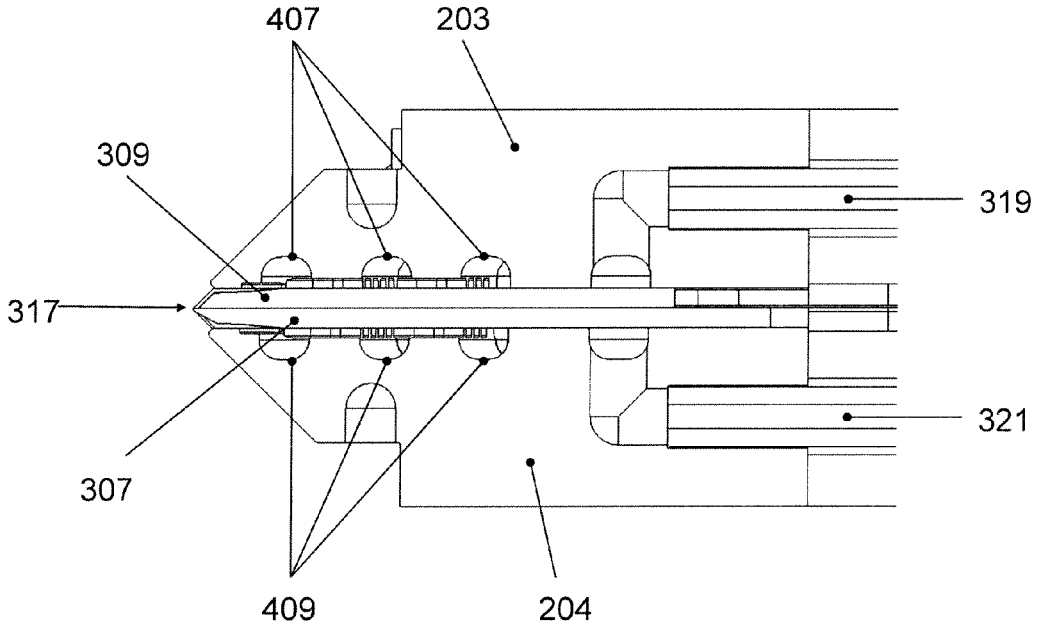
FIG. 4A is a schematic cross sectional view through the main body of the printhead illustrated in FIG. 2.
Figure 4B:
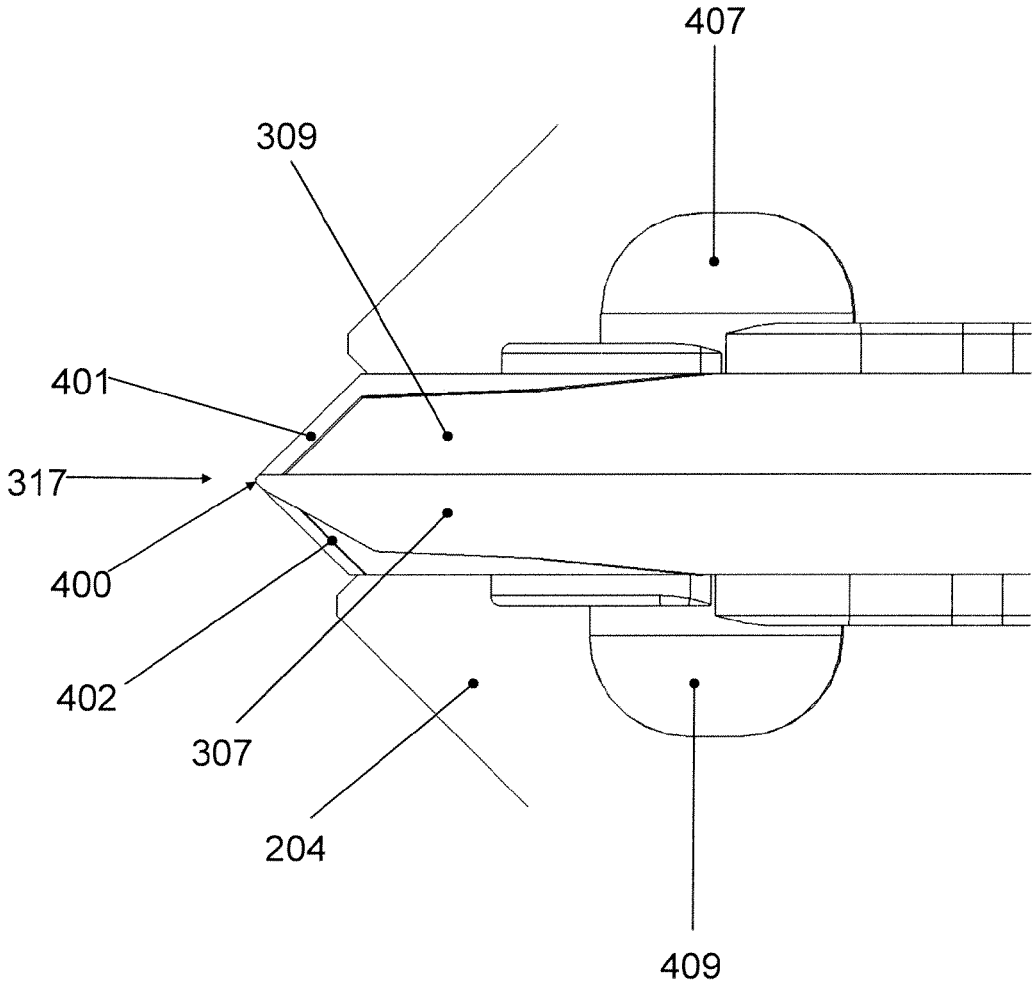
FIG. 4B is a detailed cross sectional view of the ejection region of the printhead illustrated in FIG. 2.

Referring to FIGS. 3, 4A and 4B, the main body of the printhead comprises the inflow block 203 and the outflow block 204, sandwiched between which are the prism 309 and the central tile 307. The central tile 307 has an array of ejection locations 317 along its front edge (not shown in FIG. 3) and an array of electrical connections 331 along its rear edge. Each ejection location 317 comprises an upstand 400 with which an ink meniscus interacts (in a manner well known in the art). On either side of the upstand 400 is an ink channel 402 that carries ink past both sides of the ejection upstand 400. In use, a proportion of ink is ejected from the ejection locations 317 to form, for example, the pixels of a printed image. The ejection of ink from the ejection locations 317 by the application of electrostatic forces is well understood by those of skill in the art and will not be described further herein.

The prism 309 comprises a series of narrow channels 401, corresponding to each of the individual ejection locations 317 in the central tile 307 (in FIG. 3 a representative portion of the channels 401 are illustrated at each end of the prism 309 but the skilled person will appreciate that the series of channels 401 extends across the entire face/width of the prism 309). The ink channels 402 of each ejection location 317 are in fluid communication with the respective channels 401 of the prism 309, which are, in turn, in fluid communication with a front portion of the inlet manifold 407 formed in the inflow block 203 (said inlet manifold 407 being formed on the underside of the inflow block 203 as it is presented in FIG. 3 and thus not shown in that view). Below the ejection locations 317, the ink channels 402 of the central tile 307 extend away from the ejection locations 317 on the underside of the central tile 307 to a point where they become in fluid communication with a front portion of the outlet manifold 409 formed in the outflow block 204.

The ink is supplied to the ejection locations 317 by means of an ink supply tube 319 in the printhead 201 which feeds ink into the inlet manifold 407 within the inflow block 203. The ink passes through the inlet manifold 407 and from there through the channels 401 of the prism 309 to the ejection locations 317 on the central tile 307. Surplus ink that is not ejected from the ejection locations 317 in use then flows along the ink channels 402 of the central tile 307 into the outlet manifold 409 in the outflow block 204. The ink leaves the outlet manifold 409 through an ink return tube 321 and passes back into the bulk ink supply.

The channels 401 of the prism 309 which are connected to the individual ejection locations 317 are supplied with ink from the inlet manifold 407 at a precise pressure in order to maintain accurately controlled ejection characteristics at the individual ejection locations 317. The pressure of the ink supplied to each individual channel 401 of the prism 309 by the ink inlet manifold 407 must be equal across the entire width of the array of ejection locations 317 of the printhead 201. Similarly, the pressure of the ink returning from each individual channel 402 of the central tile 307 to the outlet manifold 409 must be equal across the entire width of the array of ejection locations 317, because the inlet and the outlet ink pressures together determine the quiescent pressure of ink at each ejection location 317.

Figure 5:
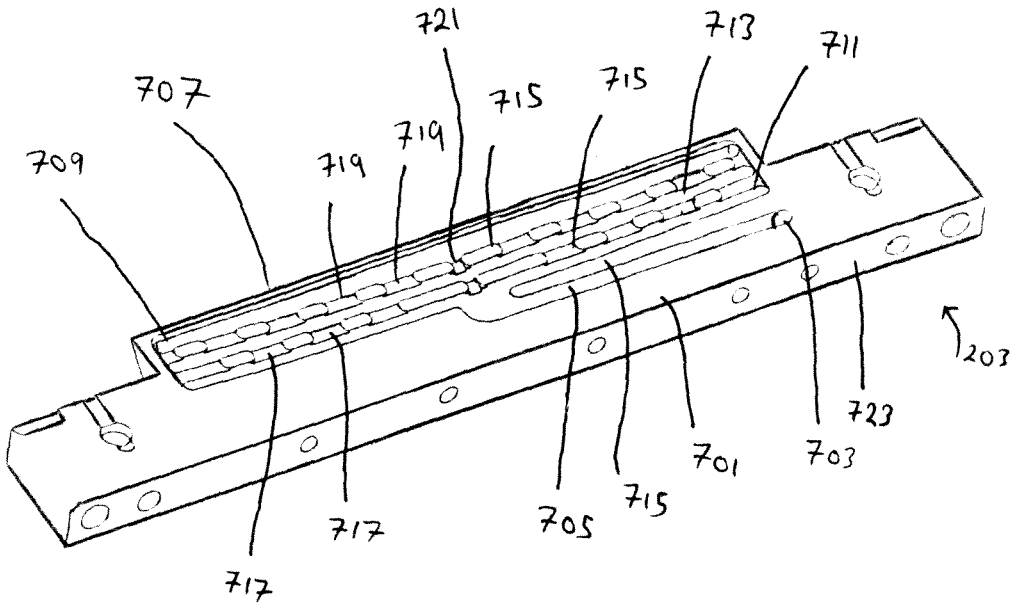
FIG. 5 is a perspective view of the inlet manifold according to the present invention.
Figure 6:
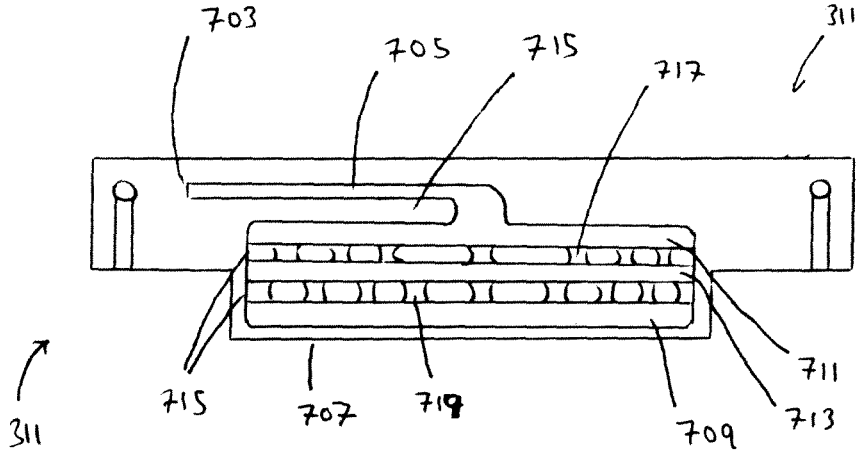
FIG. 6 is a plan view of the inlet manifold according to the present invention.

FIGS. 5 and 6 show a perspective and plan view, respectively, of the inlet manifold of the present invention, shown upside down with respect to FIGS. 2 and 3 in order to reveal the detail of the manifold shape. The inflow block 203 is a substantially solid block which may be made of MACOR, alumina or other high stiffness material, chosen to impart precision and stability to the printhead assembly. The inflow block 203 is substantially longer in a first, length, direction (i.e. the direction along which the ejection locations 317 are arrayed in the printhead 201) than in the width direction (where the width dimension is from the front of the inflow block i.e adjacent to the ejection locations, to the back of the inflow block opposite the side nearest the ejection locations) or in a thickness direction measured from the top surface of the inflow block to the bottom surface of the inflow block. In a preferred embodiment, the inflow block is 9 mm thick, has a width of approximately 30 mm and has a length of 110 mm. Mounting structures for joining the inflow block to the rest of the structural layers which make up the printhead, and for securing the printhead in the printer in which it operates, extend the overall length of the inflow block to approximately 170 mm. The skilled person will see that the inflow block of the present invention is planar or substantially planar.

The inlet manifold 407 is formed in the interior surface 701 of the inflow block 203 (that is, the surface that faces the prism 309 within the printhead assembly; thus, in the arrangement illustrated in FIG. 3, the inlet manifold 407 is formed on the underside 311 of the inflow block 203). It comprises three similar, transversely disposed channels that are substantially parallel to the long side of the inflow block 203 and which extend across the full width of the ejector array. These channels will be referred to as the front transverse channel 709, the intermediate transverse channel 713 and the rear transverse channel 711.

The front transverse channel 709 is situated adjacent the front face 707 of the inflow block 203. From FIGS. 4A and 4B it can be seen that, when the inflow block 203 is assembled into the printhead, the front transverse channel 709 is directly connected to the array of ejection locations 317 in the central tile 307 via the channels 401 in the prism 309 which are in direct fluid communication with the front transverse channel 709.

The intermediate and rear transverse channels 713, 711, which correspond in shape and appearance to the front transverse channel 709, are formed in the same surface 701 of the inflow block 203. The intermediate and rear transverse channels 713, 711 are arranged substantially parallel to the front transverse channel 709 and extend along the surface 701 of the inflow block 203 for the same length as the front transverse channel 709 thus completing the shape of the inlet manifold 407. The intermediate and rear transverse channels 713, 711 are in fluid communication with a supply of ink and are arranged to receive ink from the supply as will be described in more detail below. Neither of the intermediate or rear transverse channels 713, 711 are connected directly to the ejection locations.

At the rear of the inflow block 203 is located an ink supply port 703 into which the ink supply tube 319 fits and which feeds ink from the bulk supply to a supply channel 705 also formed in the same surface 701 of the inflow block 203 as the front, intermediate, and rear transverse channels 709, 711, 713. The ink supply port 703 is positioned on a face of the inflow block 203 towards one of the short sides of the inflow block 203 where it will not interfere with any of the electrical connections 331 to the central tile 307 where they emerge from the rear of the printhead, when the printhead is assembled. The supply channel 705 carries the ink from the ink supply port 703 to the mid-point of the rear transverse channel 711.

In the assembled printhead, an upper surface of the prism 309 lies flat against, and seals against, the surface 701 of the inflow block 203 in which the inlet manifold is formed thereby enclosing the channels 705, 709, 711, 713 formed in the surface of the inflow block 203. This is illustrated in FIGS. 3, 4A, and 4B. As said channels of the inlet manifold are formed as channels in the surface 701 of the inflow block 203, they are separated by the material of the inflow block 203, located between each channel, which have not been channeled out of the surface of the inflow block. These separating regions 715 provide a barrier to ink flow between the front, intermediate, and rear transverse channels 709, 711, 713 of the inlet manifold. Each channel has a depth of between approximately 1 to 2 mm as measured from the surface 701 of the inflow block 203 and each extends approximately 100 to 110 mm in length. In a preferred embodiment, the depth of each of the channels is 1.5 mm as measured from the surface 701. Additionally, the width of each of the channels is preferably between approximately 2 to 5 mm.

A plurality of passages 717 are formed through the separating region 715 which separates the rear and intermediate transverse channels 713, 711 from each other and further similar passages 719 are also formed through the separating region 715 which separates the intermediate transverse channel 713 from the front transverse channel 709. Each connecting passage allows ink to flow between the channels it connects.

Furthermore, each connecting passage has a length, as measured substantially parallel to the length of the channels, between 2 to 10 mm. Each connecting passage has a width, being the distance between the channels which the connecting passage connects, of between 1 to 3 mm. Each connecting passage also has a depth, as measured from the surface of the inflow block of between 0.2 to 0.9 mm.

In a preferred embodiment, each passage is approximately 5 mm long in the direction of the long side of the inflow block 203 and has a depth of approximately 0.5 millimeters measured from the surface 701 of the inflow block 203. In this preferred embodiment, by comparison, each of the transverse channels 709, 711, 713 has a depth of approximately 1.5 millimeters as measured from the surface 701.

Hence the skilled person will appreciate that the structure of the inlet manifold 407 thus formed has three comparatively deep, high volume channels (which are enclosed channels when the printhead is assembled) that form reservoirs where pressure is equalised by the transverse flow of ink (i.e. the ink spreads along the length of each of the transverse channels 709, 711, 713 perpendicular to the direction of general ink supply which is from the rear of the printhead where ink enters at the rear of the inflow block 203 to the front of the printhead where the ejection locations 317 are located). The succession of three such transverse channels/reservoirs 709, 711, 713, separated by comparatively high-flow-resistance passages arrayed along the length of the transverse channels 709, 711, 713, provides for successively more uniform pressure across the length of the inlet manifold 407 until, at the exit of the front transverse channel 709 (i.e. where the front transverse channel 709 joins with the channels 401 in the prism 309), the pressure of ink entering each prism channel 401 is substantially equal.

As described above, the front, intermediate, and rear transverse channels 709, 711, and 713 are substantially parallel to the longest side of the inlet manifold 407. However, in the preferred embodiment, the rear and intermediate transverse channels 711 and 713 and the rear edge of the front transverse channel 709 (the edge closest to the intermediate transverse channel), whilst being substantially parallel, are actually angled by approximately 2 degrees measured from their midpoint towards the front edge 707 of the manifold. Thus clearly in this arrangement the intermediate and rear transverse channels, 711 and 713 have a uniform channel width (i.e. as measured in the direction from the side of the manifold closest to the ejection locations towards the rear of the manifold opposite said ejection locations) albeit that each of these two channels is angled along its length with respect to the front edge 707 of the inlet manifold towards it by approximately 2 degrees. By contrast, the edge of the front transverse channel 709 closest to the front edge 707 of the manifold (i.e. closest to the ejection locations) is indeed parallel to that front edge 707 whilst its rear edge is angled along the length of the front transverse channel 709 approximately 2 degrees from parallel in a direction towards the front edge on either side of the midpoint of the channel. Thus the channel width of the front transverse channel 709 tapers along its length from a maximum width of approximately 4.2 mm at the mid-point of the length of the channel to a minimum width of approximately 2.5 mm at the two opposite ends of the length of the channel.

The angled arrangement so described assists with the removal of air from the inlet manifold 407 when the printhead is in use and mounted in an orientation whereby the ejectors are pointing downwards. Further to this end, a central passage 721, similar to the passages 717, exists between the rear and intermediate transverse channels 711 and 713 and the front transverse channel 709, through which air bubbles can be removed from the manifold via the supply channel 705.

The outlet manifold 409 is substantially identical in principle and form to the inlet manifold 407 and is formed, in a similar way to that in which the inlet manifold 407 is formed in the inflow block 203, in a surface of the outflow block 204. As shown in FIG. 3, the surface of the outflow block 204 in which the outlet manifold 409 is formed faces the underside of the central tile 307. In the assembled printhead, the central tile 307 seals against the surface of the outflow block 204 in which the outlet manifold 409 is formed, thereby enclosing the channels of the outflow manifold 409 so that they effectively form enclosed tunnels rather than having an open surface. From FIGS. 4A and 4B it can be seen that, when the outflow block 204 is assembled into the printhead, the front transverse channel of the outflow manifold 409 is connected to the array of ejection locations 317 in the central tile 307 via the channels 402 in the central tile 307. At the rear of the outflow block 204 is located an ink return port into which the ink return tube 321 fits and which returns ink that has not been ejected from the printhead from the outlet manifold 409 to the bulk supply.

The outflow block 204 is a substantially solid block which may be made of MACOR, alumina or other high stiffness material, chosen to impart precision and stability to the printhead assembly. The outflow block 204 is substantially longer in a first, length, direction (i.e. the direction along which the ejection locations 317 are arrayed in the printhead 201) than in the width direction (where the width dimension is from the front of the outflow block i.e adjacent to the ejection locations to the back of the outflow block opposite the side nearest the ejection locations) or in a thickness direction measured from the top surface of the outflow block to the bottom surface of the outflow block. In a preferred embodiment, the outflow block is 10.9 mm thick, has a width of 30 mm, and has a length of 110 mm. Mounting structures for joining the outflow block to the rest of the structural layers which make up the printhead extend the overall length of the outflow block to approximately 148 mm. The dimensions of the channels and connecting passages formed in the outflow block are the same as those described in relation to the inflow block and the skilled person will see that the outflow block of the present invention is planar or substantially planar. In the outflow block, the intermediate and rear transverse channels 713, 711 are in fluid communication with a sink of ink and are arranged to pass ink to the sink as will be described in more detail below.

In operation, a continuous circulation of ink is established through the printhead from the ink supply 319 to the ink return 321. Ink is supplied to the inlet manifold 407 from the ink supply tube 319 which supplies ink to the supply channel 705 of the inlet manifold 407. Ink then flows through the supply channel 705 to the point where the supply channel 705 connects to the rear transverse manifold channel 711. Ink flows transversely, with little resistance to flow, along the rear transverse channel 711, creating a reasonably uniform ink pressure distribution along the length of the rear transverse channel 711. The skilled person will appreciate that the components of the printhead are supplied with sufficient ink that all ink flow paths and/or conduits through the assembled printhead are entirely filled with ink. There are no free surfaces of ink within the assembled printhead other than the menisci presented at each of the ejection locations.

Ink then flows from the rear transverse channel 711 into the intermediate transverse channel 713 via the passages 717 formed in the separating region 715 between the said rear and intermediate transverse channels 711, 713. The resistance to flow through the passages 717 is far higher than the resistance to flow along the rear and intermediate transverse channels 711, 713 themselves, so that ink enters the intermediate transverse channel 713 at a reasonably uniform pressure along its length across the inlet manifold. Once in the intermediate transverse channel 713, ink will again flow transversely along the length of the channel, flowing from the individual points of entry into the channel through the passages 717 through the separating region. As the ink spreads along the intermediate transverse channel the ink pressure along the length of the intermediate channel becomes more and more equalized. From the intermediate channel, the ink then flows into the front transverse channel 709 via the passages 719 formed in the separating region 715 which separates the intermediate transverse channel 713 from the front transverse channel 709. The low resistance to flow transversely along the front transverse 709 channel equalises still further the pressure of ink along the length of the manifold.

From the front transverse channel 709, ink will flow into the array of ejection locations 317 via the prism 309 which is in fluid communication with the front transverse channel 709 of the inlet manifold 407 via the channels 401 formed in the prism.

In use all of the ejectors 317 of the printhead are kept aligned in the same horizontal plane in order to equalise the hydrostatic component of pressure of the ink across the array of ejection locations. Thus the printhead may be operated in a horizontal orientation as depicted in FIG. 2, a vertical orientation with the ejection locations pointing vertically downwards, or in any other orientation provided that all of the ejectors 317 are aligned across the same horizontal plane so that the ink therein experiences the same uniform hydrostatic pressure in each of the ejectors of the printhead. Effectively, the printhead is able to operate in any orientation which does not cause one ejector tip to be located higher or lower than any other ejector tip.

Once the ink has been supplied to the array of ejection locations 317, surplus ink flows along the channels 402 in the central tile 307 to the outlet manifold 409 and then back to the bulk supply via the ink return tube 321. As the skilled person will appreciate, because the outlet manifold 409 has a similar construction (i.e. front, intermediate, and rear transverse channels) to the inlet manifold 409, the pressure distribution of ink held within the front transverse channel of the outlet manifold (i.e. the channel which first receives any surplus ink from the channels 402 in the central tile 307) is substantially uniform. This is because ink flowing into the front transverse channel from the central tile 307 finds the resistance to flow along the length of the front transverse channel to be less than the resistance to flow into the intermediate transverse channel presented by the passages through the separating region between the front and intermediate transverse channels. Thus the arrangement of the outlet manifold of the present invention presents a substantially uniform and equal back pressure to the ejection locations 317 along the length of the outlet manifold.

The pressure of ink at the ejection locations 317 is maintained slightly lower than ambient atmospheric pressure to ensure that the menisci of the free ink surfaces in the ejection locations 317 conform correctly to the features of the ejection locations 317 (this behaviour of the ink is known in the art as "pinning"). The control of the pressure of ink at the ejection locations 317 is achieved by controlling the pressures of the ink entering the supply tube 319 and exiting the return tube 321, between which a continuous, unbroken circulation of ink is maintained through the printhead. The creation of a uniform pressure of ink across the full length of the array of ejection locations 317 is dependent on the abilities of both the inlet manifold 407 and the outlet manifold 409 to equalise pressure along their lengths. The design of the inlet manifold 407 described in detail above works equally well at creating uniform pressure along its length regardless of the direction of ink flow through the manifold and, therefore, the design described in relation to the inlet manifold is also used for the outlet manifold 409 of the printhead.

The inventors have found that the particular arrangement of the inlet manifold 407 described above provides a substantially equal pressure distribution of the ink in the front transverse channel 709 and thus provides the ink to each channel 401 of the prism 309 at substantially equal pressure along the length of the ejector array. It follows that the particular arrangement of inlet manifold 407 described above provides each individual channel 401 of the prism 309 with equal flow rate of ink.

Figure 7:
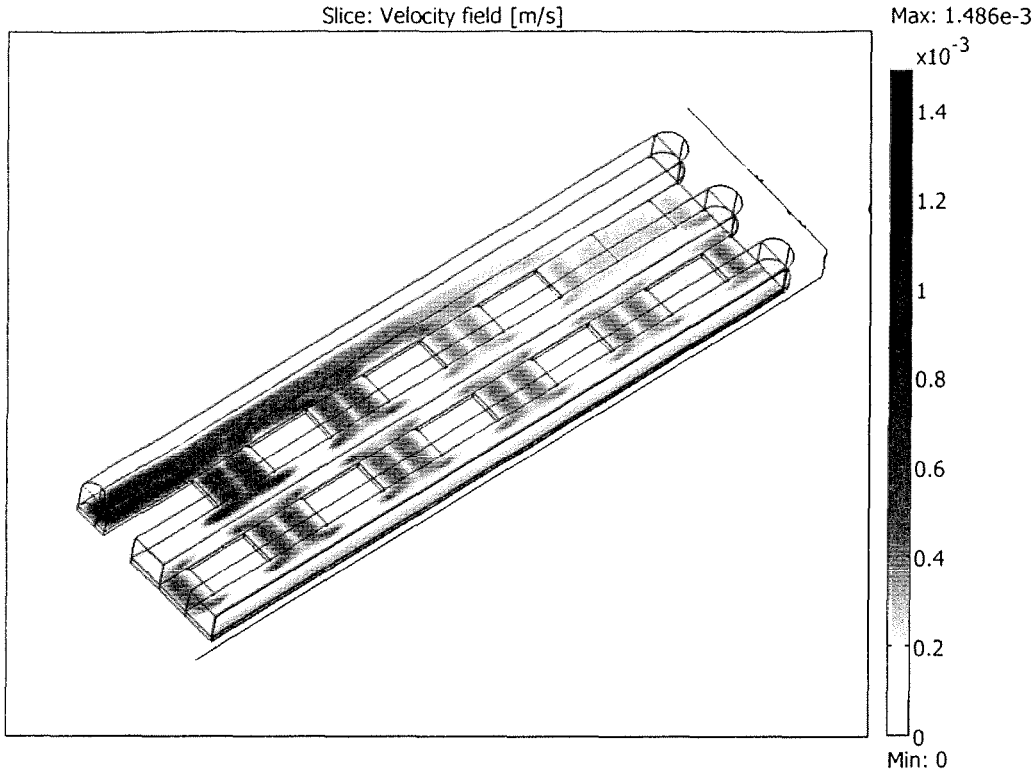
FIG. 7 is a flow rate map of the velocity distribution of ink flow through the inlet manifold of the present invention.
Figure 8:
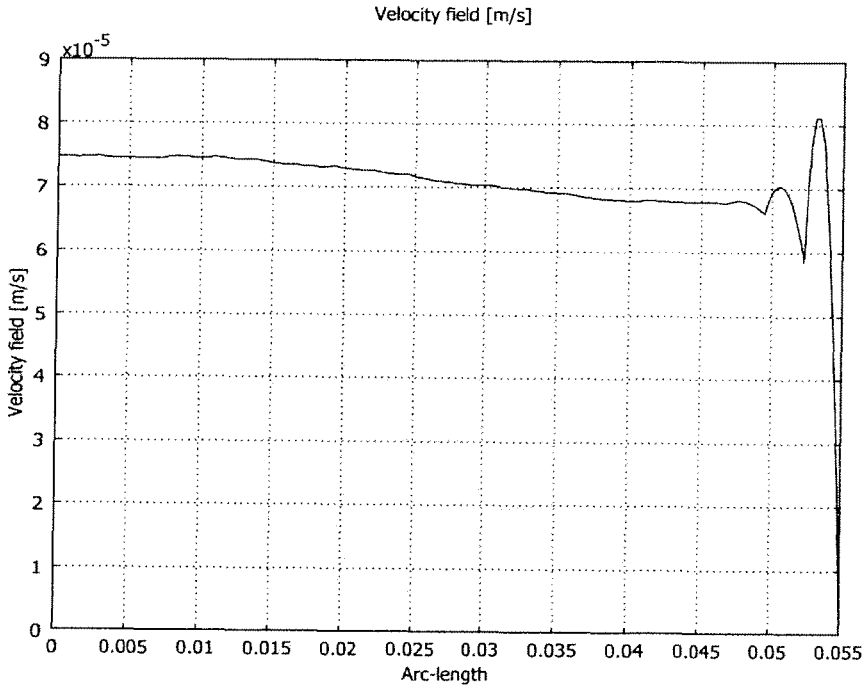
FIG. 8 is a graph of ink flow velocity against position at the outlet of the manifold of the present invention.

FIGS. 7 and 8 illustrate the flow rate distribution of ink within a manifold structure according to the present invention. Although these Figures have been produced with the manifold operating as an inlet manifold, the skilled person would readily appreciate that the pressure/flow rate distribution for the manifold operating as an outlet manifold would be identical to the Figures shown but with negative values. One skilled in the art will recognise that since the flow rate of the ink into the channels 401 of the prism 309 is proportional to the pressure difference of the ink entering the channels 401 and exiting the channels 402, a substantially uniform flow rate from (or into, in the case that the manifold is used as an outlet manifold) the front transverse channel 709 as shown in FIG. 8 also indicates substantially uniform pressure. In the simulation illustrated in FIGS. 7 and 8, only one half of the manifold structure has been modeled because the symmetry of the transverse channels 711, 713 and 709 dictates that the pressure distribution and flow rate distribution in the half not shown is simply a reflection of the half that is shown, about the vertical plane at the origin.

Thus turning to FIG. 7, it can be seen that although there is a significant flow rate/pressure gradient in the rear transverse channel 711 (which is to be expected since it is this channel which receives ink from the supply channel 705 at a single point in the plane of the origin), by the time the ink has flowed through the inlet manifold 407, the pressure/flow rate of the ink exiting the front transverse channel 709 is substantially uniform along the entire length of the front transverse channel 709.

Figure 9:
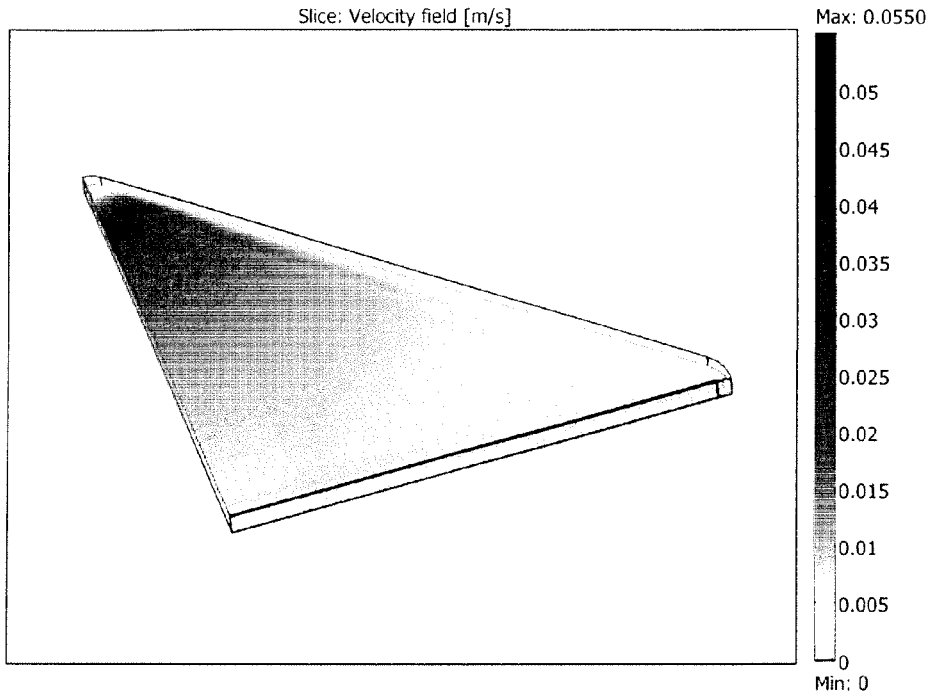
Figure 9 (PRIOR ART)
FIG. 9 is a flow rate map of the velocity distribution of ink flow through a prior art inlet manifold.
Figure 10:
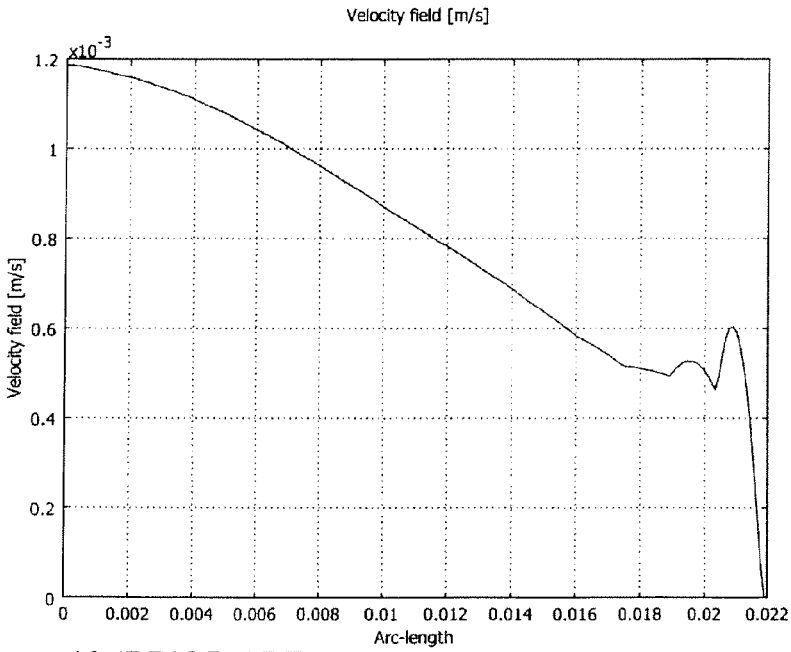
Figure 10 (PRIOR ART)
FIG. 10 is a graph of ink flow velocity against position at the outlet of the prior art manifold.

FIGS. 9 and 10 show a similar flow rate distribution map and graph for the ink inlet manifold described in WO 03/101741 in which the inlet manifold is a divergent triangular cavity (as was the case for FIGS. 7 and 8, only one half of the manifold has been modeled in FIGS. 9 and 10, the other half being a reflection in the vertical plane at the origin). Comparing the two sets of results, i.e. those produced by the manifold of the present invention as illustrated in FIGS. 7 and 8 and those of the prior art manifold illustrated in FIGS. 9 and 10, it can be readily seen that the manifold of the present invention achieves a more uniform distribution of flow rate/pressure than the manifold described in WO 03/101741 despite being substantially shorter from front to back.

Thus the present invention results in manifolds 407, 409 and printhead 201 in which it is possible to supply ink to each of the ejection locations 317 in the array of ejection locations, and receive surplus ink from the ejection locations, at substantially equal pressure and flow rate across the entire length of the array of ejection locations. Moreover, the manifolds and thus the printhead are able to be physically smaller from front to back than known printheads using conventional manifolds.

Modifications

Although the above embodiment has been described as having three manifold channels, i.e. the rear, intermediate and front manifold channels 711, 713 and 709 arranged between the ink supply channel 705 and the prism channels 401, the skilled person will readily understand that any number of intermediate manifold channels, or alternatively no intermediate channel at all, may be utilised in the present invention to obtain the constant pressure/flow rate characteristics of the manifold.

For example, rather than a single intermediate channel 703 being used as described in the present embodiment, for some applications this could be omitted such that the rear transverse channel and front transverse channel are separated by only a single row of passages 717 through the separating region 715.

Alternatively, more than the one intermediate transverse channel 713 could be supplied between the rear transverse channel 711 and the front transverse channel 709 provided that they conform to the substantially parallel arrangement required and provide the same low resistance to transverse ink flow along their lengths compared with the resistance to ink flow between respective ones of the intermediate channels presented by the passages 717, 719 through the separating regions between them.

The skilled person will also understand that variations with respect to the width, depth, length, spacing and alignment of the passages 717, 719 through the separating regions 715 which separate the manifold channels 711, 713 and 709 from each other could be varied and still fall within the scope of the present invention provided that they present a suitable restriction to the flow of ink (i.e. a greater flow restriction to ink passing between respective separated channels 709, 711, 713 via the passages 717, 719 than the flow restriction of ink simply flowing transversely along the length of the channels). Examples of alternative alignments of the passages 717, 719 have been illustrated in the Figures. Specifically, FIG. 5 illustrates a manifold where the passages 717, 719 between each respective transverse channel are staggered (to provide stable support of the prism laminate 309) with respect to those in adjacent regions, and FIG. 7, where the passages 717, 719 are illustrated as being aligned. In addition, the skilled person will understand that the sizing and shape of the transverse channels and of the connecting passages between the passages gives each of those channels and passages a particular restriction to flow of liquid/ink therein. Thus the skilled person will appreciate that the present invention encompasses any shape or sizing of the channels and connecting passages provided that the connecting passages provide a greater flow restriction to ink passing therethrough than do the transverse channels.

Furthermore, the skilled person will understand that the dimensions of the inlet channel 705, rear transverse channel 713, intermediate transverse channel 711 and front transverse channel 709 could be altered without departing from the scope of the invention provided that they remain connected to each other only by passages 717, 719 which present a higher resistance to flow than the flow resistance along the transverse channels.

Although FIG. 2 illustrates a typical printhead in which the ink manifold (either inlet or outlet) of the present invention may be employed, the skilled person will readily appreciate that the ink manifold (either inlet or outlet) could be used in a wide variety of other printheads provided those other printheads can supply ink to and receive ink from the manifold (either inlet or outlet). In such a case, the benefits provided by the manifold of the present invention (whether considering its use as an inlet manifold or as an outlet manifold) of supplying ink at a uniform pressure across the entire width of the ejector array will be realised. Whether the additional benefit of the present invention of allowing a printhead to be used which is narrower from front to back (as measured from the ejection locations to the side of the printhead opposite the ejection locations) than is typically the case will depend on the construction of the particular printhead with which the manifold is used. In addition, whilst the printhead of FIG. 2 is an electrostatic inkjet printhead, the skilled person will appreciate that the inflow and outflow manifolds described above could be used with any type of inkjet printhead.

The invention claimed is:

1. An ink manifold for an inkjet printhead, said manifold comprising an inlet or outlet port (703);

a substantially planar body (203, 204) which is longer in a length direction than a width direction and having, formed in a surface thereof, a first transverse channel (709) for direct connection to ejection locations (317) of said printhead along the length of said first channel, said first channel extending substantially parallel to the length direction of the body (203, 204); and an adjacent transverse channel (713) extending substantially parallel to the length direction of the body (203, 204), said adjacent transverse channel being in fluid communication with said inlet or outlet port and hence to a supply or sink of ink respectively, and arranged between said inlet or outlet port and said first transverse channel to receive ink from said supply or pass ink to said sink and supply ink to or receive it from said first transverse channel, wherein said adjacent transverse channel is not directly connected to the ejection locations (317);

wherein two or more connecting passages (719) are arranged between adjacent ones of said transverse channels (709, 713), operable to allow ink to flow between the transverse channels (709, 713);

wherein each connecting passage (719) is sized such that it provides a greater flow restriction to ink flowing between the transverse channels (709, 713) than the restriction to flow of ink along the length of each transverse channel (709, 713) so that the pressure distribution of ink within said first transverse channel (709) is substantially uniform along the length of said channel.

2. The ink manifold of claim 1, further comprising:

at least one further transverse channel (711), extending substantially parallel to the length direction of the body (203, 204), and connected between said adjacent transverse channel (713) and said ink supply or sink via two or more additional connecting passages (717), wherein said adjacent transverse channel is in fluid communication with said supply or sink of ink via said at least one further transverse channel.

3. The ink manifold of claim 2, wherein one or more of said connecting passages (717, 719) connecting one pair of said transverse channels (709, 711, 713) is offset with respect to one or more of the connecting passages (717, 719) connecting an adjacent pair of channels (709, 711, 713), and the connecting passages (717, 719) being arranged along substantially the length of a corresponding pair of said transverse channels (709, 711, 713).

4. The ink manifold of claim 1, wherein each channel has a depth of 1 to 2 millimeters as measured from the surface of said body (203, 204) in which it is formed.

5. The ink manifold of claim 1, wherein each channel has a width substantially between 2 to 4 millimeters and a length substantially between 100 and 110 millimeters.

6. The ink manifold of claim 1, wherein each said two or more connecting passages (717, 719) has a depth of 0.5 millimeters as measured from the surface of said body (203, 204) into which it is formed.

7. The ink manifold of claim 1, wherein each said two or more connecting passages (717, 719) has a length, as measured substantially parallel to the length of said channels, of between 2 to 10 millimeters and a width, said width being the distance between the adjacent channels which said passage connects, of between 1 to 3 millimeters.

8. The ink manifold of claim 1, wherein said body (203, 204) has a thickness of approximately 9 mm to 11 mm measured from a top surface to a bottom surface of said body, a width dimension of approximately 30 mm as measured from the side of the body for connection to said ejection locations (317) to the rear of the body (203, 204) opposite the side for connection to the ejection locations (317), and a length dimension of approximately 110 mm to 170 mm as measured along the side of the body along which the ejection locations (317) are arrayed.

9. The ink manifold of claim 8 wherein, said manifold allows ink to flow from the adjacent transverse channel (713) to the ejection locations (317) via the first transverse channel (709).

10. The ink manifold of claim 8 wherein said manifold allows ink to flow from the ejection locations (317) to said adjacent transverse channel (713) via said first transverse channel (709).

11. The ink manifold of claim 1, further comprising an electrostatic printhead having a housing having an inlet and an outlet for the supply and removal, respectively, of ink;

an array of ejection locations (317) for the ejection of ink droplets;

at least one of an ink supply pathway for the passage of ink from the inlet to the ejection locations (317), and an ink removal pathway for the passage of ink from the ejection locations (317) to the ink outlet, wherein the ink supply pathway comprises the ink manifold, said adjacent transverse channel (713) being operable to receive ink from said inlet for the supply of ink, and wherein the ink removal pathway comprises the ink manifold, said adjacent transverse channel (713) being operable to receive ink from said first transverse channel (709) and supply ink to said outlet.

12. The ink manifold of claim 1, wherein the printhead has a thickness of approximately 20 mm measured from a top surface to a bottom surface of the printhead, a width dimension of approximately 46 mm as measured from the ejection locations (317) to the rear of the printhead opposite the ejection locations (317), and a length dimension of 148 mm as measured along the side of the printhead along which the ejection locations (317) are arrayed.

13. The ink manifold of claim 1, wherein said adjacent transverse channel is configured to receive ink from said inlet to supply ink to the ink manifold.

14. The ink manifold of claim 1, wherein said adjacent transverse channel is configured to receive ink from said first transverse channel and supply ink to said outlet.

* * * * *